US005552348A

United States Patent [19]

Wu

[11] Patent Number: 5,552,348

[45] Date of Patent: Sep. 3, 1996

[54] BULB SOCKET STRUCTURE

[76] Inventor: Gordon K. H. Wu, P.O. Box 81-518, Taipei, Taiwan

[21] Appl. No.: 371,989

[22] Filed: Jan. 12, 1995

[51] Int. Cl.[6] ..... H01R 4/24

[52] U.S. Cl. ..... 439/419; 439/340

[58] Field of Search ..... 439/419, 658, 439/340, 659

[56] References Cited

U.S. PATENT DOCUMENTS

| | | | |
|---|---|---|---|
| 2,636,069 | 4/1953 | Gilbert | 439/419 |
| 5,350,315 | 9/1994 | Cheng et al. | 439/659 |
| 5,421,742 | 6/1995 | Huang | 439/419 |
| 5,474,467 | 12/1995 | Chen | 439/419 |

*Primary Examiner*—Gary F. Paumen

*Attorney, Agent, or Firm*—Ostrolenk, Faber, Gerb & Soffen, LLP

[57] ABSTRACT

A bulb socket structure includes a socket housing to receive therein a bulb, first and second electrically-conductive members which are located within a channel formed on the socket housing to have sharpened tips thereof piercing into and forming electrical connections to a power cord extending through the channel, the first member having a U-shaped portion received within a first hole formed on the socket to be substantially centrally-located within the socket housing and the second member having an inner end inserted into a second, eccentric hole of the socket housing to partially extend into the socket housing, a support member formed inside the socket housing to hold the second member for preventing the second member from being deformed by the insertion of the bulb to short-circuit with the hot plate, and an end cap or cover releasably mounted to the socket housing to cover and confine the first and second electrically-conductive members and the power cord between the socket housing and the cover so that the power cord is located between the first member and the cover and the resiliency of the insulation sheath of the power cord makes the physical contact of the first and second electrically-conductive members with the bulb base more effective and secure.

6 Claims, 7 Drawing Sheets

BULB SOCKET STRUCTURE

FIELD OF THE INVENTION

The present invention relates generally to a bulb socket structure.

BACKGROUND OF THE INVENTION

Bulb sockets are commonplace in connecting a light bulb to a power cord. A conventional bulb socket as shown in FIG. 7 generally comprises a housing 10 having defined therein an internal space to receive therein a light bulb through an opening thereof. A pair of electrically-conductive members 11, generally in the form of elongated strips, are provided inside the bulb housing 10 to serve as hot contact and neutral contact between the light bulb and the power cord. Conventionally, the electrical connection between the strips 11 and the power cord is established by securing conductive material of the power cord, which is embedded inside an insulation sheath of the power cord, to the conductive strips 11 by means of screws. Such a process of connecting a bulb socket to a power cord is obviously tedious and costly and not suitable for mounting a great number of bulb sockets to a power cord.

Further, the conventional design of the conductive strips 11 has a severe disadvantage. That is to provide a better physical contact between the bulb base of the light bulb and the conductive strips 11, the conductive strips 11 are usually bent to lean toward the bulb base, as shown in FIG. 7. This, however, usually causes one of the conductive strips 11 to be further bent by the insertion of the bulb base into the socket housing 10, as indicated by arrow 12, so as to cause the two conductive strips 11 to contact each other and thus short-circuiting.

SUMMARY OF THE INVENTION

Accordingly, it is an object of the present invention to provide a bulb socket structure which has two electrically-conductive members so arranged as not to contact and thus short-circuit with each other but still maintaining excellent electrical contact with the bulb base.

Another object of the present invention is to provide a bulb socket structure which requires no screwing is securing the bulb socket to a power cord.

To achieve the above-mentioned objects, there is provided a bulb socket structure comprising a socket housing to receive therein a bulb, first and second electrically-conductive members which are located within a channel formed on the socket housing to have sharpened tips thereof piercing into and forming electrical connections to a power cord extending through the channel, the first member having a U-shaped portion received within a first hole formed on the socket to be substantially centrally-located within the socket housing and the second member having an inner end inserted into a second, eccentric hole of the socket housing to partially extend into the socket housing, a support member formed inside the socket housing to hold the second member for preventing the second member from being deformed by the insertion of the bulb to short-circuit with the hot plate, and an end cap or cover releasably mounted to the socket housing to cover and confine the first and second electrically-conductive members and the power cord between the socket housing and the cover so that the power cord is located between the first member and the cover and the resiliency of the insulation sheath of the power cord makes the physical contact of the first and second electrically-conductive members with the bulb base more effective and secure.

The above object, features and advantages of the invention will become readily apparent from the following detailed description thereof which is to be read in connection with the accompanying drawings.

DETAILED DESCRIPTION OF THE PREFERRED EMBODIMENTS

Figure 1:
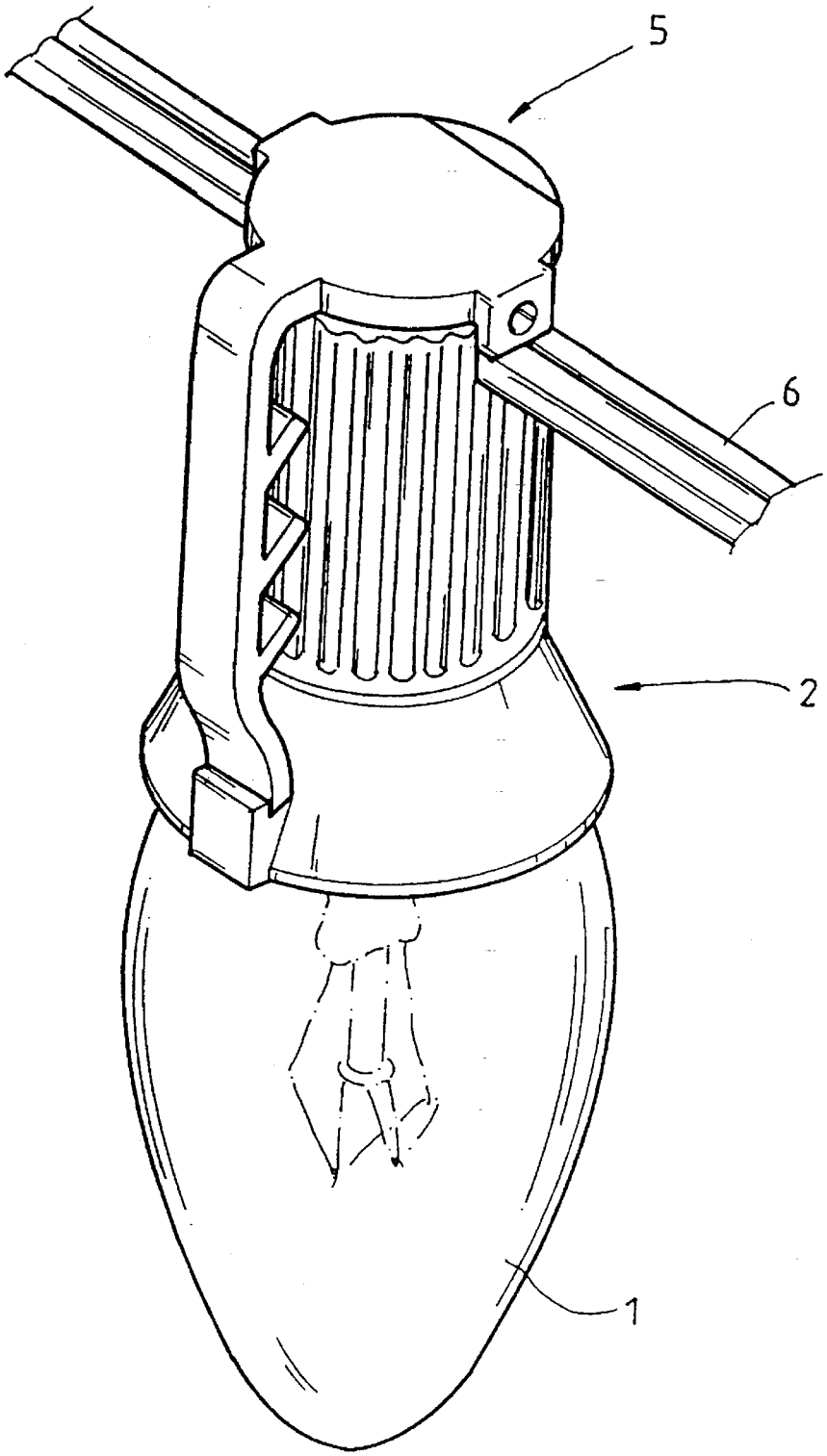
FIG. 1 is a perspective view showing a bulb socket constructed in accordance with the present invention mounting a bulb to an external power cord.

Referring to the drawings and in particular to FIG. 1, wherein a bulb socket constructed in accordance with the present invention, generally designated with the reference numeral 2, is shown mounting a light bulb 1 to an external power cord 6. The power cord 6 preferably comprises a hot wire and a neutral wire. Further referring to FIGS. 2 and 3, the bulb socket 2 comprises a socket body or housing having formed on a first end 22 thereof a hot plate positioning hole 25 and a neutral plate positioning hole 232 to respectively receive and retain therein a pair of electrically-conductive members, serving as hot plate 3 and neutral plate 4. An end cap 5 is provided to fit onto the first end 22 of the bulb socket body 2 to cover the conductive members 3 and 4.

Figure 5:
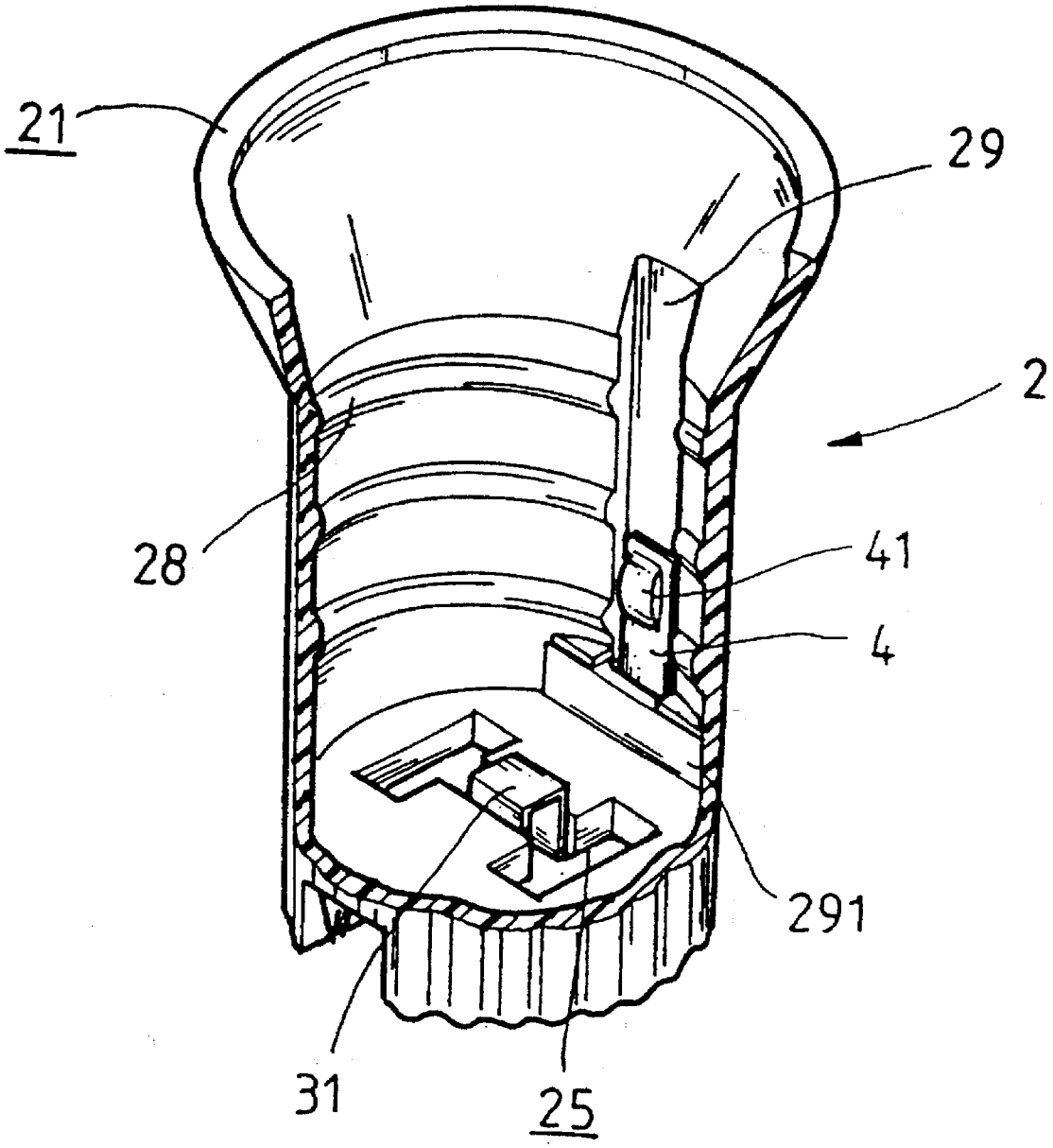
FIG. 5 is a perspective view of the bulb socket of the present invention, partially broken to show the inside structure thereof.

As shown in FIG. 5, the socket body 2 defines therein an internal space with a divergingly expanded opening 21 formed on a second end thereof to threadingly receive therein a bulb base (not shown in the drawings) of the light bulb 1 by means of a helical thread 28.

Referring again to FIGS. 2 and 3, the socket body 2 has formed on the first end 22 thereof an axially-extending well 24 and a laterally-extending wire channel 23 extending substantially normal to the well 24. The wire channel 23 has a bottom side on which a first opening 25 and a second opening 232 are formed to be in communication with the internal space of the socket body 2 and serving as the hot plate positioning hole and the neutral plate positioning hole. A retaining slit 231 is also formed on the channel 23 in the proximity of the first opening 25.

Figure 6:
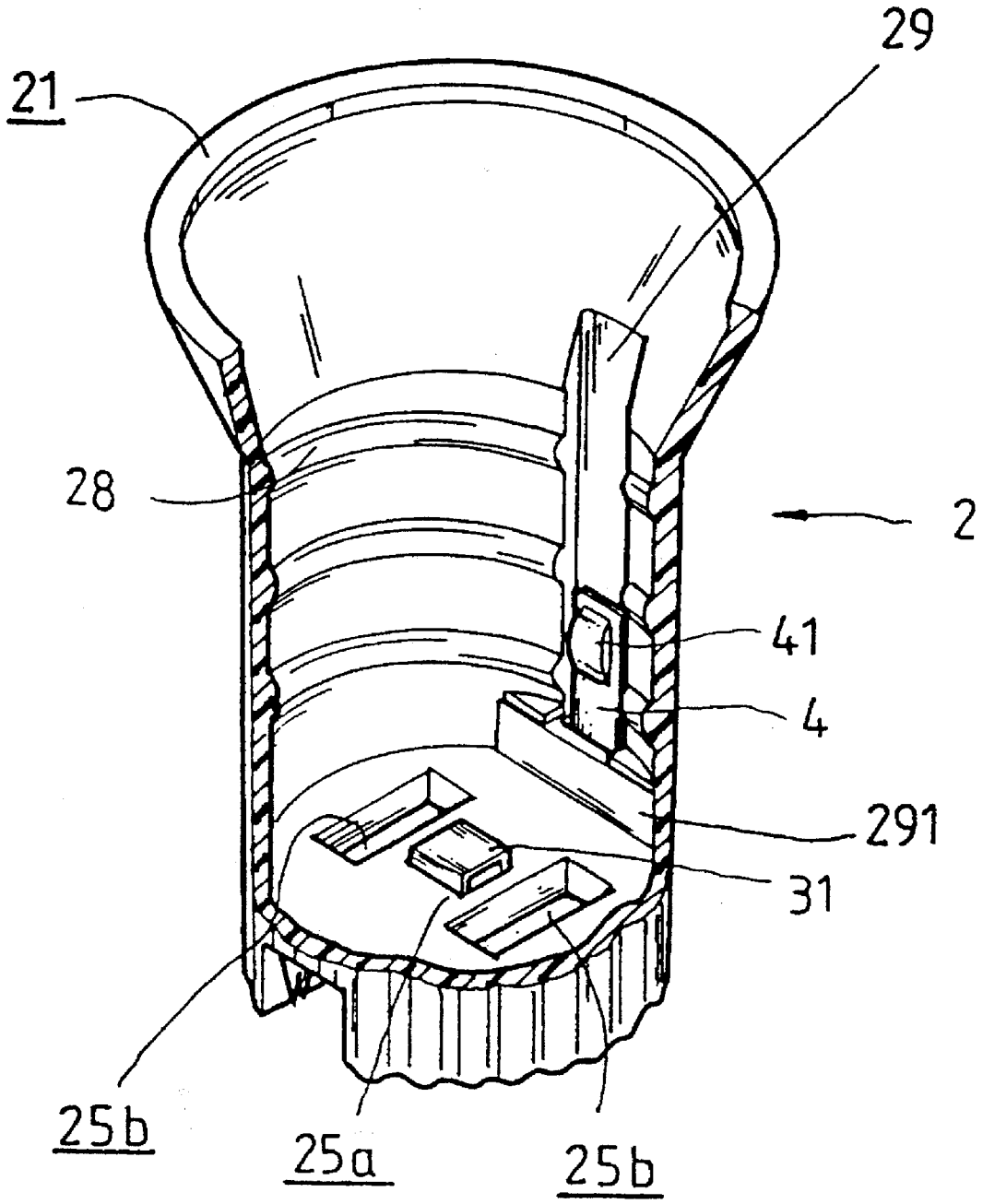
FIG. 6 is a perspective view of a second embodiment of the bulb of the present invention, partially broken to show the inside structure thereof.
Figure 7:
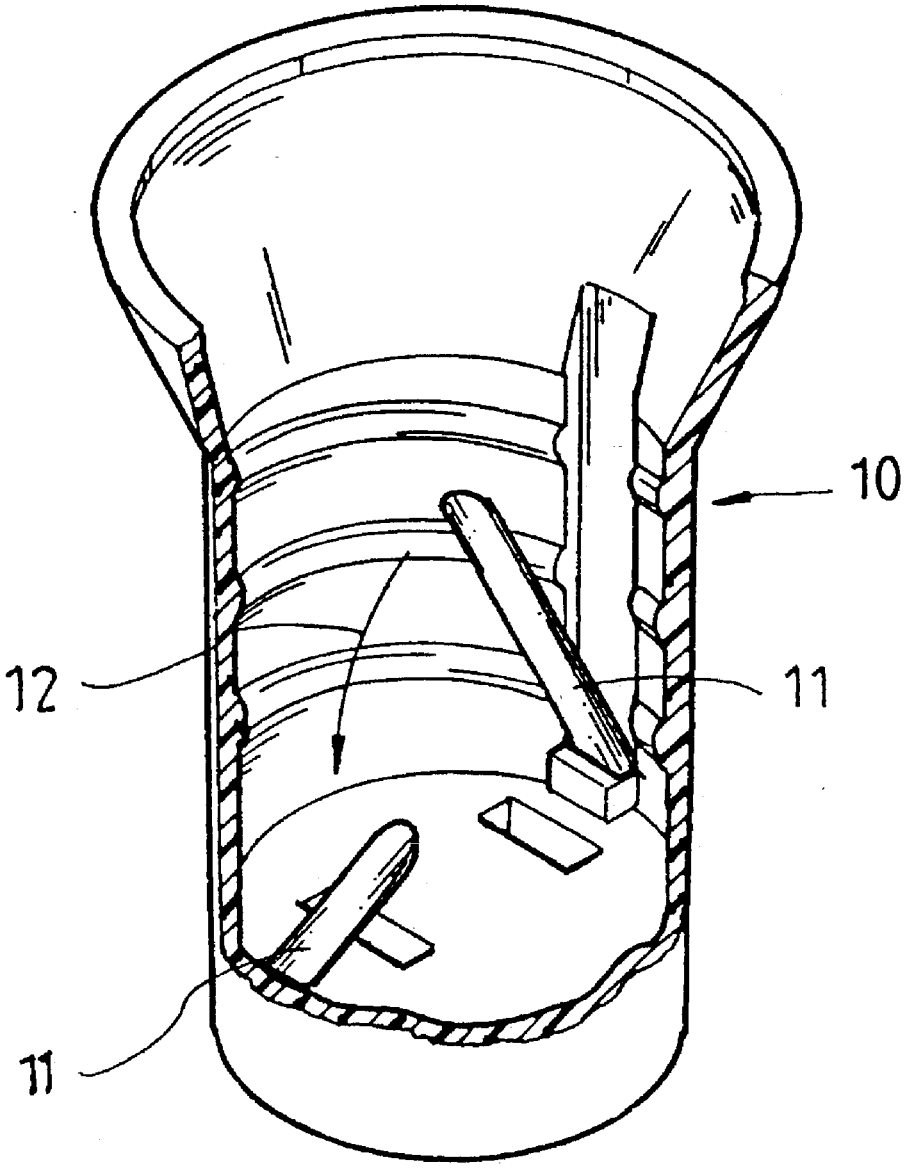
FIG. 7 PRIOR ART
FIG. 7 is a perspective view, partially broken, showing the structure of a prior art bulb socket.

In the embodiment illustrated, the first opening 25 has an I-shaped cross section with the central trunk of the I located on the bottom of the wire channel 23 and the top and bottom bars of the I extending outside the wire channel 23 but located within the well 24. FIG. 5 shows the inside detail of the socket body 2 which is partially broken to allow the I-shaped opening 25 to be visible inside the socket body 2. It is however possible to separate the two bars of the I from the trunk thereof, as shown in FIG. 6 which is similar to FIG. 5, but showing a second embodiment of the present invention wherein the I-shaped first opening 25 of the first embodiment shown in FIG. 5 is modified to form three separate openings, a central opening 25*a* and two side openings 25*b*. In the embodiment shown in FIG. 6, the central opening 25*a* takes the place of the I-shaped opening 25 of the embodiment shown in FIG. 5 to serve as the hot plate positioning hole.

Figure 2:
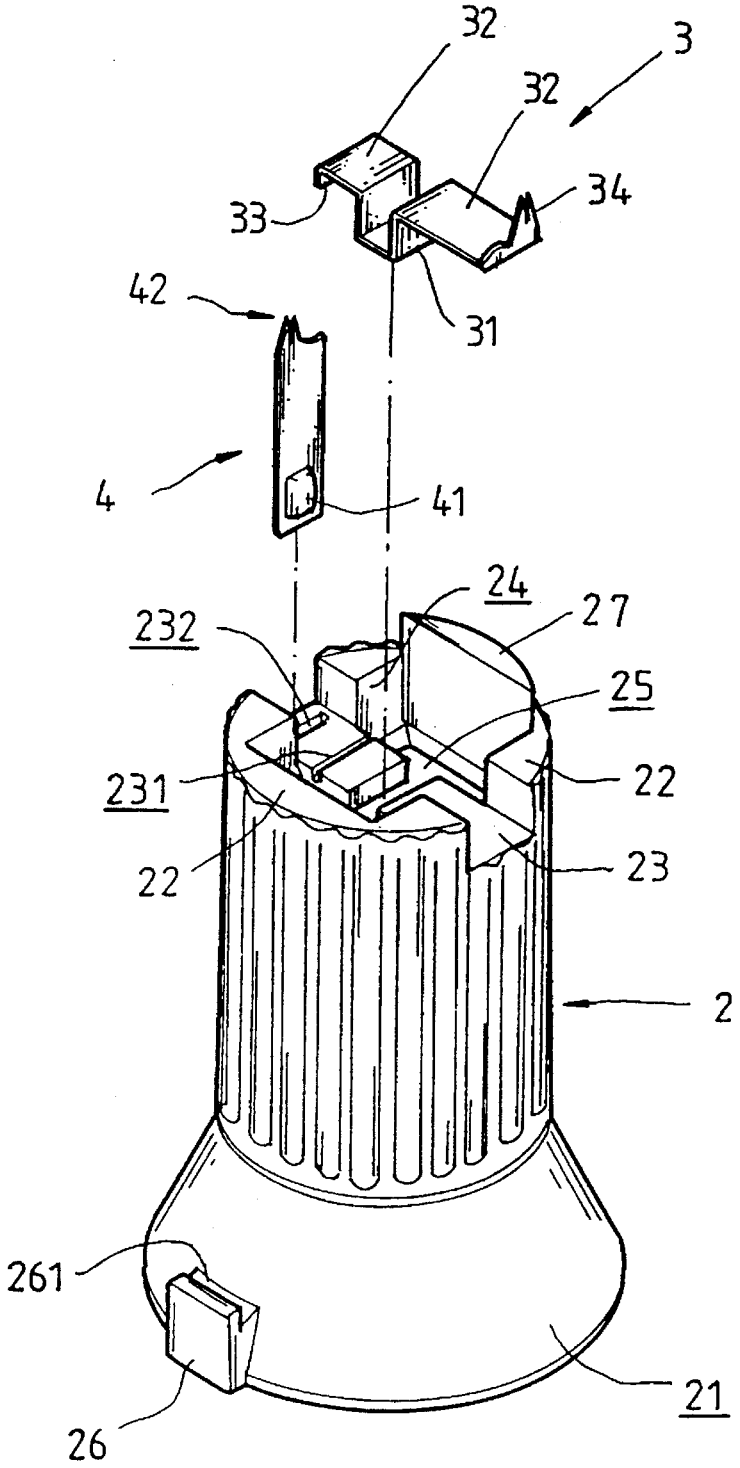
FIG. 2 is an exploded perspective view showing the bulb socket of the present invention with an end cap thereof removed to show electrically-conductive members thereof.

With reference to FIG. 2, the first electrically-conductive member, the hot plate 3, comprises a U-shaped central portion 31 having two side extensions 32. The hot plate 3 is disposed within and extending with the wire channel 23 with the U-shaped portion 31 received within the trunk of the I-shaped opening 25 and partially extending into the internal space of the socket body 2, as shown in FIG. 5, to contact the tip contact of the bulb base (not shown), the side extensions 32 of the hot plate 3 being supported on the wire channel 23. A retainer tab 33 is provided on remote end of a first one of the side extensions 32 which is formed by bent the remote end of the first extension 32 approximately 90 degrees to allow the retainer tab 33 to be forcibly insertable into the retaining slit 231 to secure the hot plate 3 on position. A sharpened tip 34 is provided on remote end of a second one of the side extensions 32 and is bent to be substantially normal to the second side extension 32 to point away from the socket body 2. Preferably, the sharpened tip 34 of the hot plate 3 is eccentrically located with respect to the wire channel 23.

The second conductive member, the neutral plate 4, comprises a flat body having a first end inserted into the second opening 232 to partially extend into the internal space of the socket body 2. The socket body 2 comprises an axial slot 29 formed on an internal wall thereof to be in communication with the second opening 232 so as to allow the first end of the neutral plate 4 to be located within the slot 29. A raised portion 41 is formed on the first end of the neutral plate 4 to partially project out of the slot 29 to contact the ring contact of the bulb base (not shown). The neutral plate 4 has a sharpened tip 42 formed on a second end thereof which extends into the wire channel 23 but located eccentrically with respect to the wire channel 23 in a direction opposite to that of the sharpened tip 34 of the hot plate 3.

The socket body 2 has formed inside the internal space thereof a support 291 which extends across a lower portion of the slot 29 to shield and thus hold a portion of the neutral plate 4. The support 291 serves to prevent the neutral plate 4 from being accidentally bent down to short-circuit with the U-shaped portion 31 of the hot plate 3 when a bulb is inserted into the socket 2.

Figure 4:
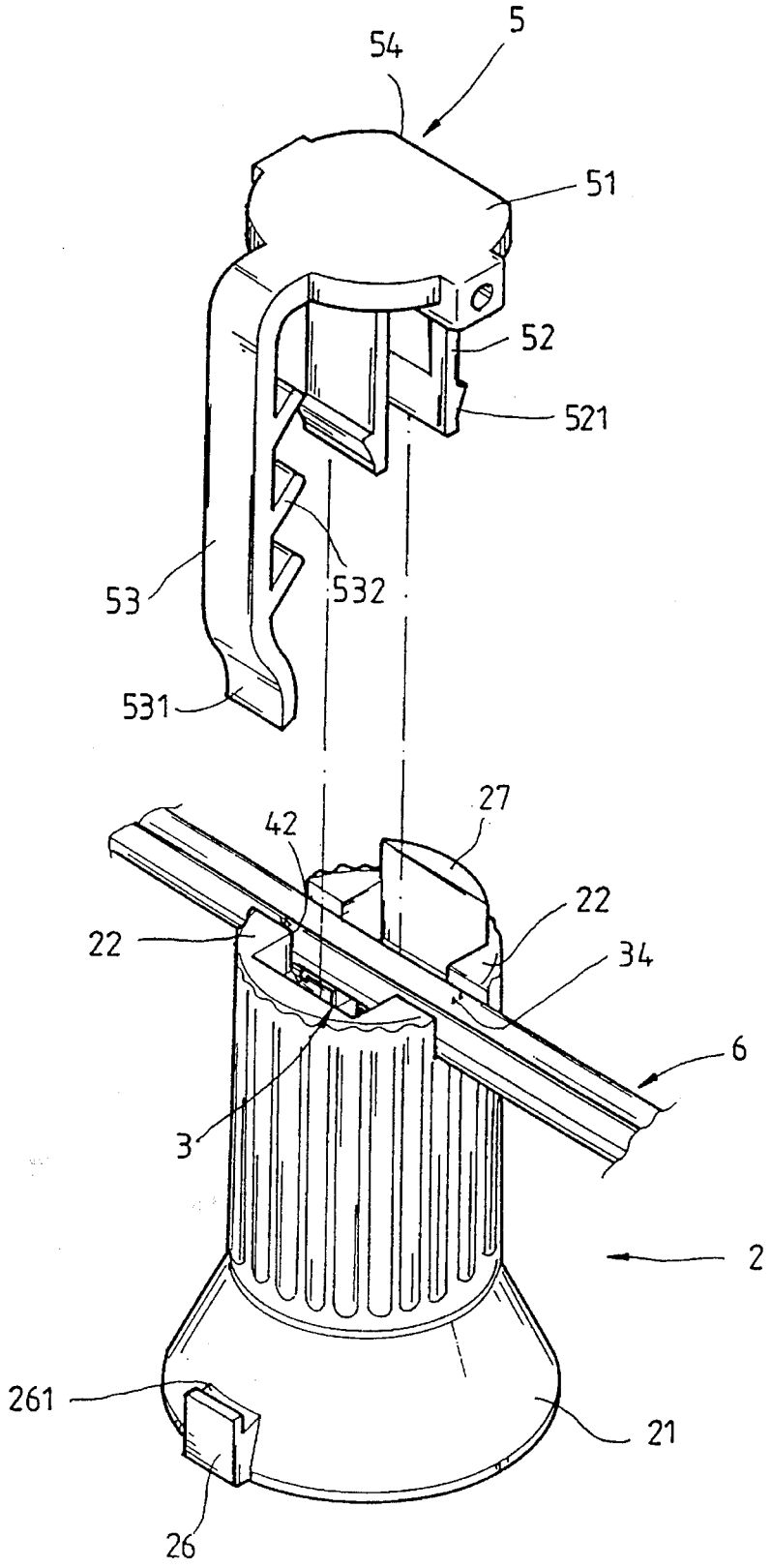
FIG. 4 is a perspective view showing the bulb socket in accordance with the present invention mounted to an external power cord, wherein the end cap is detached from the socket body.

With reference to FIG. 4, to connect the bulb socket 2 to the power cord 6, the power cord 6 is first placed into the wire channel 23 to have a portion thereof extending through the wire channel 23. The power cord 6 comprises a hot wire and a neutral wire each having conductive material enclosed by an insulation sheath and the sharpened tips 34 and 42 of the hot plate 3 and the neutral plate 4 are respectively located corresponding to the two wires of the power cord 6 so that by forcing the power cord 6 toward the bottom of the wire channel 23, the sharpened tips 34 and 42 pierce into the insulation sheath of the power cord 6 to be in electrical connection with the conductive material inside the power cord 6. In this way, electrical connections between the bulb socket 2 and the power cord 6 is established without any screws.

Figure 3:
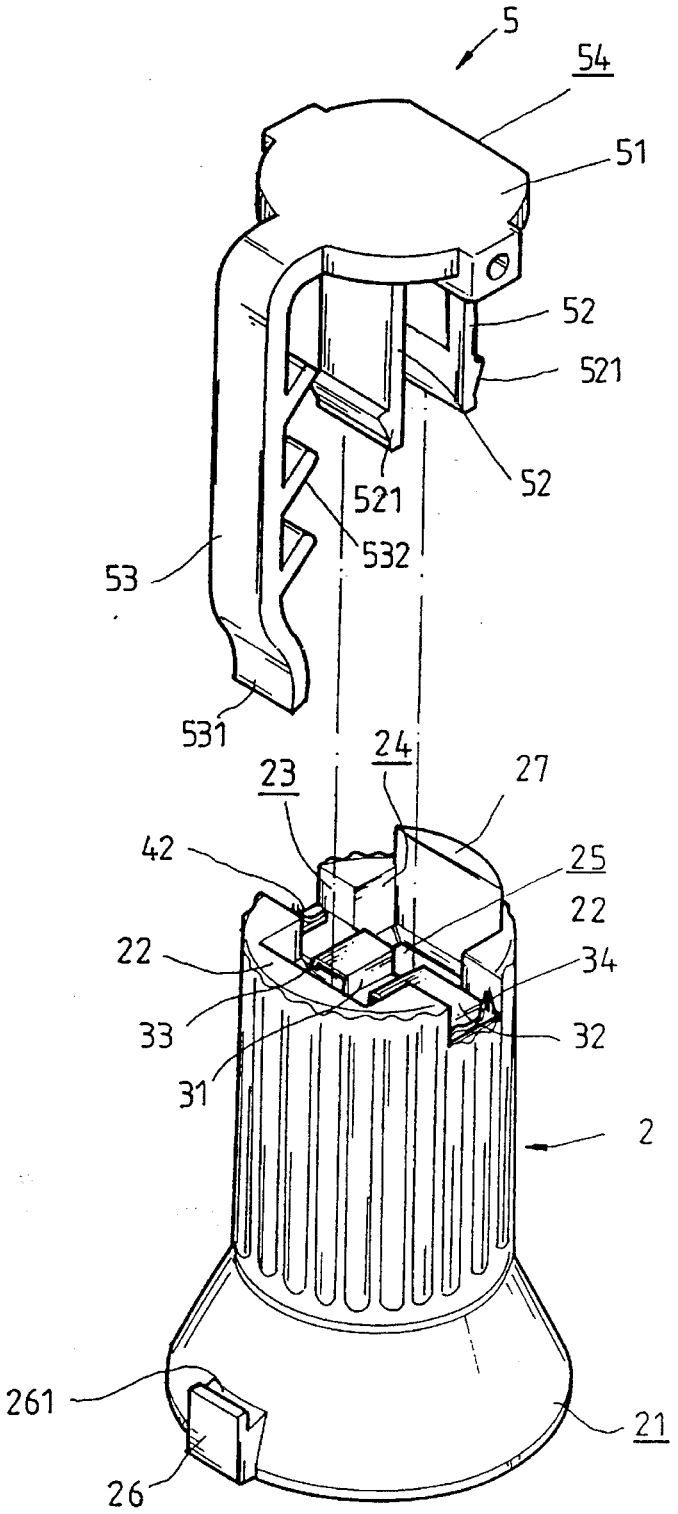
FIG. 3 is an exploded perspective view showing the bulb socket in accordance with the present invention with the electrically-conductive members assembled therein.

To push the power cord 6 toward the bottom of the wire channel 23 and to secure the power cord 6 within the wire channel 23, an end cap 5 is provided to fit into the well 24 formed on the first end 22 of the socket body 2. As shown in FIGS. 3 and 4, the end cap 5 comprises a body 51 having formed on a bottom side thereof a pair of paws 52 each having a hooked end 521 depending from the body 51 to be insertable into the top and bottom bars of the I-shaped opening 25 and extending into the internal space of the socket body 2 and thus engaging edges of the opening 25 to secure the end cap 5 on the first end 22 of the socket body 2 by the engagement between the paws 52 and the first opening 25. By fitting the end cap 5 onto the first end 22 of the socket body 2, the power cord 6 is forced to move toward the bottom of the wire channel 23 by the cap body 51 so as to force the sharpened tips 34 and 42 to pierce into the power cord 6.

The end cap 5 may also be provided with a hanger bar 53 which extends toward the expanded opening 21 of the socket body 2 from the end cap 5. The hanger bar 53 has a free end 531 which is elastically deformable to releasably engage a recess 261 of a holder 26 formed in the proximity of the expanded opening 26 to be frictionally fixed therein. The hanger bar 53 has formed thereon a plurality of inward projections 532 which abut against the socket body 2 when the free end 531 is engaged by the holder 26 to define therebetween gaps which allow slender supporting members, such as tree twigs or branches, to extend therethrough for hanging the bulb socket 2 thereon.

Preferably, the socket body 2 is provided with a raised wall 27 on the first end 22 thereof to matingly engage a lateral surface 54 of the end cap 5 for more precisely positioning the end cap 5 relative to the socket body 2.

In the second embodiment shown in FIG. 6, the U-shaped portion 31 of the hot plate 3 is received within the central opening 25*a* and the paws 52 are inserted into the side openings 25*b*.

In general, the insulation sheath of the power cord 6 is made of plastics that has a resiliency and the U-shaped portion 31 of the hot plate 3 has also certain resilience so that a resilient contact between the tip contact of the bulb base and the hot plate 3 can be accomplished which ensures a good electrical connection between the hot plate 3 and the light bulb.

Having described the specific preferred embodiments of the present invention with reference to the accompanying drawings, it will be appreciated that the present invention is not limited to that precise embodiments and that various changes and modifications can be effected therein by one of ordinary skill in the art without departing from the scope or spirit of the invention as defined by the appended claims.

What is claimed is:

1. A bulb socket structure for mounting a light bulb which has a bulb base having a tip contact and a ring contact to an external power cord which comprises a pair of wires each having conductive material enclosed by an insulation sheath to establish an electrical connection therebetween, comprising a socket housing defining therein an internal space to receive therein the light bulb through a bulb insertion opening; a first electrically-conductive member having a first contact formed thereon engageably received within a first slot formed on a first end of said socket housing to partially extend into the internal space of said socket housing, the first electrically-conductive member having a first sharpened tip so shaped and located as to be pierceable through the insulation sheath of a first one of the wires of the power cord to be in electrical connection with the conductive material thereof; the first electrically-conductive member comprises a U-shaped portion having two side extensions, one of the side extensions having formed on a free end thereof a retaining tab forcibly fit into corresponding slit formed on the first end of the socket housing to retain the first electrically-conductive member on the socket housing and the other one of sid extensions having a free end with the sharpened tip formed thereon, the U-shaped portion of the first electrically-conductive member being received and retained within the first slot to serve as the first contact; a second electrically-conductive member insertable into a second slot formed on the first end of said socket housing to have a second contact formed thereon extend into the internal space of said socket housing, the second electrically-conductive member having a second sharpened tip pierceable through the insulation sheath of a second one of the wires of the power cord to be in electrical connection with the conductive material thereof; said first and second contacts of the first and second electrically-conductive members being so located within the internal space of the socket housing to be respectively electrically contactable with the tip contact and the ring contact of the light bulb so that said first and second electrically-conductive members electrically connect the light bulb to the power cord; a support member formed inside said socket housing to shield and hold a portion of said second electrically-conductive member extending into the internal space of the housing so as to prevent the second electrically-conductive member from being deformed by the insertion of the light bulb into the internal space of the socket housing; and an end cap fitted on the first end of said socket housing to cover and securely confine said first and second electrically-conductive members and the power cord between said socket housing and said end cap.

2. The bulb socket structure as claimed in claim 1, wherein the socket housing comprises a pair of retaining holes formed on the first end thereof and wherein the end cap comprises two paws each having a hooked free end to be insertable into and thus engageable with the retaining holes of the socket housing to secure the end cap to the socket housing.

3. The bulb socket structure as claimed in claim 1, wherein said socket housing comprises a channel formed on the first end thereof to receive therein the power cord, the sharpened tips of the first and second electrically-conductive members being located within the channel to respectively correspond to the wires of the power cord so as to each pierce into the respective one of the wires.

4. The bulb socket structure as claimed in claim 1, wherein the second electrically-conductive member comprises an elongated plate having a first end inserted into the second slot to extend into the internal space of the socket housing and a second end having the sharpened tip formed thereon, the first end of the second electrically-conductive member having a raised portion formed thereon and located inside the internal space of the socket housing to serve as the second contact.

5. The bulb socket structure as claimed in claim 1, wherein said end cap comprises a hanger bar extending therefrom to have a free end thereof releasably engageable with a holder formed in the proximity of the bulb insertion opening of the socket housing to define a gap between the hanger bar and the socket housing adapted to receive a slender member therethrough for hanging the bulb socket on the slender member.

6. The bulb socket structure as claimed in claim 5, wherein the hanger bar comprises at least an inward projection to abut against the socket housing to define the gap between the hanger bar and socket housing.

* * * * *

US005552348B1

REEXAMINATION CERTIFICATE (3293rd)

United States Patent [19] [11] B1 5,552,348

Wu [45] Certificate Issued Aug. 5, 1997

[54] BULB SOCKET STRUCTURE

[76] Inventor: Gordon K. H. Wu, P.O. Box 81-518, Taipei, Taiwan

Reexamination Request:
No. 90/004,494, Dec. 23, 1996

Reexamination Certificate for:

| | |
|---|---|
| Patent No.: | **5,552,348** |
| Issued: | **Sep. 3, 1996** |
| Appl. No.: | **371,989** |
| Filed: | **Jan. 12, 1995** |

[51] Int. Cl.[6] ..... H01R 4/24
[52] U.S. Cl. ..... 439/419; 439/340
[58] Field of Search ..... 439/419, 658, 439/340, 659

[56] References Cited

U.S. PATENT DOCUMENTS 5,389,008 2/1995 Cheng et al. ..... 439/419

*Primary Examiner*—Gary F. Paumen

[57] ABSTRACT

A bulb socket structure includes a socket housing to receive therein a bulb, first and second electrically-conductive members which are located within a channel formed on the socket housing to have sharpened tips thereof piercing into and forming electrical connections to a power cord extending through the channel, the first member having a U-shaped portion received within a first hole formed on the socket to be substantially centrally-located within the socket housing and the second member having an inner end inserted into a second, eccentric hole of the socket housing to partially extend into the socket housing, a support member formed inside the socket housing to hold the second member for preventing the second member from being deformed by the insertion of the bulb to short-circuit with the hot plate, and an end cap or cover releasably mounted to the socket housing to cover and confine the first and second electrically-conductive members and the power cord between the socket housing and the cover so that the power cord is located between the first member and the cover and the resiliency of the insulation sheath of the power cord makes the physical contact of the first and second electrically-conductive members with the bulb base more effective and secure.

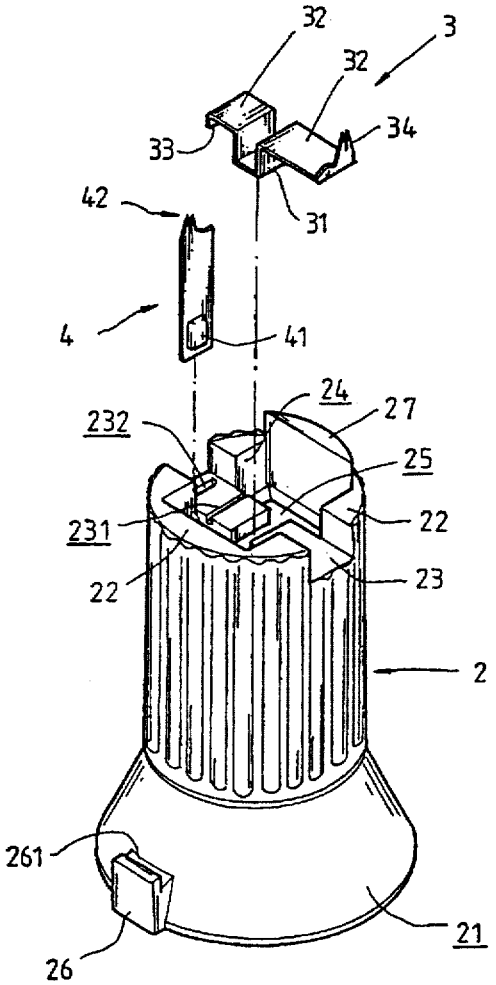

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *